United States Patent [19]

Tallant

[11] 4,026,120

[45] May 31, 1977

[54] NATURAL GAS THERMAL EXTRACTION PROCESS AND APPARATUS

[75] Inventor: James L. Tallant, Dallas, Tex.

[73] Assignee: Halliburton Company, Duncan, Okla.

[22] Filed: Apr. 19, 1976

[21] Appl. No.: 677,941

[52] U.S. Cl. ..... 62/5; 62/23

[51] Int. Cl.[2] ..... F25B 9/02; F25J 3/06

[58] Field of Search ..... 62/5, 23

[56] References Cited

UNITED STATES PATENTS

| | | | |
|---|---|---|---|
| 2,522,787 | 9/1950 | Hughes | 62/23 |
| 2,683,972 | 7/1954 | Atkinson | 62/23 |
| 2,807,156 | 9/1957 | Van Dongen | 62/5 |
| 3,775,988 | 5/1969 | Fekete | 62/23 |

*Primary Examiner*—Jack Sofer

*Attorney, Agent, or Firm*—Robert S. Nisbett; John H. Tregoning; Thomas R. Weaver

[57] ABSTRACT

The invention of this application relates to the production and transportation of hydrocarbons which are initially or normally in the gaseous state. Specifically, the invention provides processes and an apparatus for drying or removing water vapor and condensable hydrocarbons and other condensable components from the natural gas stream.

6 Claims, 2 Drawing Figures

NATURAL GAS THERMAL EXTRACTION PROCESS AND APPARATUS

As a natural stream is produced from a well or transported through equipment and pipelines under varying conditions, certain components condense to liquids and frequently form solid hydrates or liquid emulsions. These liquids or solids interfere with the transportation of the gas and operation of the various equipment components.

This invention provides a basic process with several modifications for efficiently removing condensable components from the natural gas stream which form the hydrates or emulsions. Normally methane is the principal component of natural gas. Frequently, natural gas contains other components such as water vapor and high molecular weight hydrocarbons such as ethane, propane, butane, pentane, hexane, heptane, etc. which have about 2–8 carbon atoms per molecule. Natural gas may also contain undesirable gases such as hydrogen sulfide and carbon dioxide. Many of these components are condensable under certain conditions of temperature and pressure. By providing a low temperature environment under conditions which will not restrict the flow of the natural gas stream even when hydrates or condensate are formed, the process of this invention effectively removes these condensable components.

The processes and apparatus of this invention can treat natural gas streams which are high in water vapor or higher hydrocarbons. For example, the gas stream can contain only 60–70% methane with the balance being condensable hydrocarbons which principally contain about five carbon atoms or fewer per molecule. High moisture content gas can also be processed but each component of the process or apparatus must be sized to process special streams or streams having wide variations in volumes, conditions or component concentrations. Since condensable hydrocarbons are a desirable by-product, high concentrations of $C_3$–$C_8$ condensable hydrocarbons are desirable with the methane in the natural gas stream. Temperature and pressure of the natural gas feed stream determine the quantity of condensable hydrocarbons which are hydrocarbons having at least three carbon atoms per molecule and are considered normally liquid hydrocarbons. Preferred processes and apparatus of this invention can be designed in view of this disclosure to recover nearly 100% and typically more than 95% of the normally liquid hydrocarbons having at least four carbon atoms per molecule. Furthermore, the processes of this invention are more efficient and economical than conventional low temperature natural gas treating processes for recovering these condensable hydrocarbons and producing a dry natural gas stream which can be readily handled by most conventional storage, transportation and processing facilities. Dry natural gas as produced by the processes of this invention typically contains less than about seven pounds of water vapor per million cubic feet of gas processed per day (MMCFD) and has water vapor and condensable component concentrations so that the dry natural gas product will not encounter dew point conditions under normal pipeline transporting conditions. In other words, the hydrocarbon dew point of the product gas is typically at least 20° F.

The processes of this invention are especially adaptable for processing natural gas where hydrates are encountered. Hydrates are hydrocarbon crystal or an icy hydrocarbon-water solid or sludge mixture which frequently causes blockage of equipment and fluctuation of treating efficiency and effectiveness. The processes and apparatus of this invention are designed to continuously and effectively remove hydrates and to recover the valuable components of the hydrates. A preferred apparatus of this invention will be referred to as "HTX" unit which includes the use of conventional low temperature separators such as an "LTX" unit.

The high molecular weight hydrocarbons are a by-product of the natural gas treating process of this invention. The low temperature process of this invention and apparatus for the process can use standard equipment components common to the oil, gas and chemical process industries. These equipment components include items such as a low temperature separator, standard solid-liquid-gas separators, vortex tube separator-expander, and heat exchangers with conventional piping and valving arrangements. The piping, valves and control mechanism are connecting means. Conventional piping, valves, temperature controls and pressure controls can be used in view of this disclosure.

The basic process of this invention can be described as a method of treating a natural gas stream in a closed energy cycle process to recover condensable components in said stream comprising cooling a high pressure natural gas stream to a temperature in a range of about 25°–60° F (−3.9° to 15.6° C) by passing said high pressure gas stream through a cold environment provided by an expanded gas; separating condensed components from said high pressure gas stream; introducing said cooled high pressure gas stream into a vortex chamber tangentially, expanding said gas at a high velocity, and separating said gas stream into a hot gas stream and a cold gas stream; passing said cold gas stream into said cold environment provided by expanded gas in or from an expanded gas separator to recover the condensable components in said cold environment as liquid product; passing said hot gas stream through a cooler or heat exchanger where it is cooled by a gaseous or liquid product from said expanded gas separator and introducing said cooled hot gas stream into said expanded gas separator; adjusting the temperature and pressure of the expanded gas and passing the expanded gas to a gas products receiver from said expanded gas separator; and adjusting the temperature and pressure of the liquid product and passing said liquid product to a liquid products receiver from said expanded gas separator. The gas and/or liquid product receivers can be a conventional vessel, pipeline or equipment for further treating or storage.

In some processes additional temperature or pressure adjustment may not be desirable. In other words, the temperature and/or pressure of each stream may be regulated and adjusted to the desired values as the stream flows through the process and apparatus. In other processes it may be desirable to maintain values which would require a separate adjustment as the stream exits the process or apparatus so that the stream would be more compatible with the receiver. For example, it may be desirable to flash or lower the pressure of various gas or liquid streams to recover components which might later separate from that stream in the receiving means, such as flashing lighter components from the liquid hydrocarbon stream. These lighter components could be added to the gas product stream.

The cooling steps for various streams can be provided by separate pieces of equipment or by equipment which serves more than one function. For example, the high pressure gas stream can be cooled in several steps by having multiple sets of coils in the expanded gas separator or "LTX" unit. The various sets of coils can be immersed in one or more liquid phases or suspended in the gaseous phase to obtain cooling by the desired stream. Likewise, the cooling or heat exchange can be performed in separate heat exchange equipment by withdrawing the desired streams and passing them through (preferably in counter current flow) the heat exchange equipment.

In a preferred process, the initial cooling step can be accomplished in one or more steps with separation of the cooled gas and any condensed liquid prior to and between each cooling step. A preferred expanded gas separator is commonly known as an "LTX" unit or a low temperature separator such as described in U.S. Pat. Nos. 2,656,896; 2,657,760; 2,971,342; and 3,073,091 which are incorporated herein by reference. Treating equipment and conditions are also described in GAS CONDITIONING AND PROCESS by John M. Campbell, published by Campbell Petroleum Series, 121 Collier Drive, Norman, OK 73069, which is incorporated herein by reference. The separators used between cooling steps can be any type of solid-liquid-gas separator which will remove liquids, sludge or solids which are formed in the gas stream. These are typically referred to as "knock-out" pots or "LKO" units in the industry. Special provisions may be required to prevent plugging when hydrates are formed. Dehydration may be required. Hydrates should be produced and removed in separators designed to handle hydrates rather than in other processing equipment.

In a preferred process, the natural gas stream is initially cooled to a temperature in the range of about 45°–60° F (7.2°–15.6° C) (or preferably with a temperature decrease of about 20°–40° F [−6.7° to 4.4° C]) and subsequently cooled to a temperature of about 25°–50° F [−3.9 to 10.0° C] (or preferably with a temperature decrease of about 20°–40° F) prior to entering the vortex tube expander. These initial cooling steps are preferably accomplished by passing the natural gas stream through a cold environment provided by the expanded gas separator. This can be accomplished by a standard unit which has a first set of coils submerged in the liquid phase of the separator and a second set of coils in the gaseous phase where an entering expanding gas stream impinges on the second set of coils. The first set of coils also serves to provide heat to the liquid phase which melts any hydrates which form and thereby maintains at least two liquid phases when there is both water vapor and condensable hydrocarbons present in the natural gas stream. Heat exchange or cooling is accomplished by passing one stream in one direction on one side of a coil or pipe and the other stream generally in the opposite or counter current direction on the other side of the coil. Other methods and equipment for heat exchange can be used in view of this disclosure. The components and arrangement of equipment in the process of this invention serve to minimize or eliminate problems of flow restrictions due to hydrate and condensate formation, yet effectively removes these condensable components to produce a dry natural gas stream which can be effectively processed and transported under normally encountered field conditions.

Figure 1:
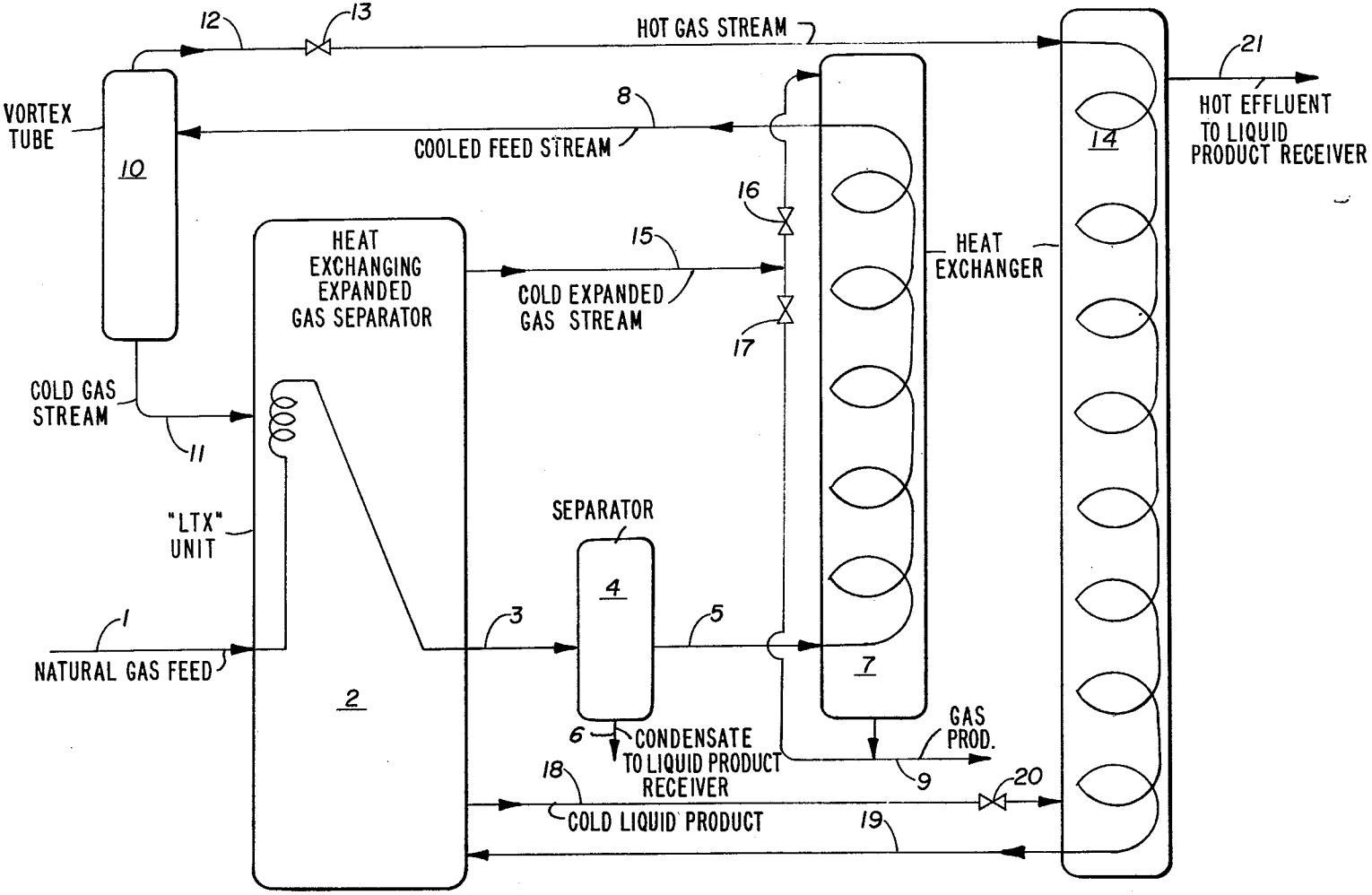
FIG. 1 illustrates a flow diagram in the treatment of natural gas employing a process of the invention.

A typical process is shown in FIG. 1 where the natural gas feed stream 1 under high pressure of at least 100 psi and preferably at least about 200–800 psi passes through the cold environment of the expanded gas separator 2. The high pressure gas is preferably cooled in one or more steps to about 25°–60° F (−3.9° to 15.6° C). The gas is expanded in the process to a pressure necessary to obtain the desired degree of cooling but is preferably maintained above an intermediate pressure in the range of about 150–250 psi. To illustrate the process, a natural gas stream of about 1.5 mmcfd (million cubic feet per day) at about 490 psi and 60°–100° F (15.6 to 37.8° C) is the natural gas feed stream which passes through the cold environment of the expanded gas separator 2 (e.g., "LTX" unit). The cold environment within the "LTX" unit is at about 245 psi and 0°–70° F (−17.8° to 37.8° C). The cooled natural gas stream 3 then passes to a separator 4 (e.g., LKO unit) at about 485 psi and 15°85° F (10.0° to 29.4° C) where the condensed liquids are removed through stream 6 as liquid product and passed to the "LTX" unit or a liquid products receiver (not shown). The exit gas stream 5 then passes through either the shell side or tube side of the cooler or heat exchanger 7. Typically, the high pressure gas stream will pass through the tube side of a heat exchanger to reduce the cost of high pressure equipment. However, under some circumstances other factors such as condensate formation, heat exchange efficiency or other factors may influence the selection of equipment and routing of the various streams. The cooled natural gas feed stream exits the heat exchanger as stream 8 and passes into the vortex tube at a pressure of about 475 psi and 35°–70° F. The vortex tube or chamber 10 serves to separate and expand the high pressure natural gas stream. The gas stream enters the vortex tube tangentially or in a swirling pattern at a very high velocity near that of sound. A cold gas stream 11 is separated and removed from the vortex tube and passed to the expanded gas separator or "LTX" unit 2. The cold gas stream is allowed to expand freely into the vortex tube and into the "LTX" unit where condensable liquids and hydrates are separated from the gas stream by baffles and by a gravitational separation chamber.

In a preferred "LTX" unit the expanded cold gas stream which enters the "LTX" unit impinges on at least one of the coils through which the feed natural gas stream is passing. This type of preferred "LTX" unit is described in detail in National Tank Company Catalog 401-1 (July 1958) at about pages 403–406 which is incorporated herein by reference. In a preferred "LTX" unit the hydrates and condensed liquids fall to the lower portion of the unit and form at least one liquid phase. Normally, the hydrates are melted by heat from the feed gas streams and form a water layer below the condensed hydrocarbons. From the vortex tube a hot gas stream 12 is removed at a pressure of about 250 psi. This hot gas stream is typically controlled or throttled by valve 13 to control the proportion of hot gas and cold gas stream emerging from the vortex tube. Typically, the hot gas stream is less than about 40 volume percent of the cooled feed gas stream and preferably less than about 40 percent. The hot gas stream at about 45°–80° F (7.2°–26.7° C) passes as stream 12 to heat exchanger 14 where it is cooled by liquid product stream 18 from the expanded gas separator 2. The cooled hot gas stream 19 at about 245 psi and 30°–80° F (−1.1° to 26.7° C) then passes into the expanded gas separator where liquids are removed from this stream. This gas stream then blends or mixes with the other gases in the separator. The liquid product stream 18 from the expanded gas separator 2 is controlled by valve 20 as it passes through the heat exchanger and emerges as stream 21 at a pressure of about 40 psi and 40°–80° F (4.4° to 26.7° C) to a liquid product receiver (not shown). The liquid product stream can be either water or condensed hydrocarbons or both depending upon the quantity of each produced. Typically, the quantity of water condensed in the separator will be relatively small and this can be removed as a separate stream (not shown) from the separator using baffles and liquid level controls which are standard in the industry. The hot gas stream can also be cooled by the gas product instead of or in addition to the liquid product. Likewise, the feed gas stream can be cooled by one or more liquid product streams instead of or in addition to cooling by the gas product stream.

The expanded gas stream or gas product stream 15 is withdrawn from the separator 2 and passed to heat exchanger 7 to further cool the high pressure natural gas feed stream 5 before the cooled feed stream 8 is expanded in the vortex chamber 10. The quantity of gas product 15 used to cool the feed gas is controlled by valves 16 and 17 or other valving arrangements to maintain the desired temperature distribution throughout the system. Gas product stream 15 either flows through valve 17 or valve 16 and heat exchanger 7 where the streams are combined at juncture 9. For this illustration, the product gas at juncture 9 is typically at about 240 psi and 50°–78° F (10.0° to 25.6° C). The temperature and pressure can be adjusted by additional valves or heat exchangers to the desired values. Any adjustment in temperature and/or pressure can be accomplished throughout the system or by valves, heat exchangers, flash tanks, etc. anywhere in the system or as the stream exits the process. The stream should be adjusted as it exits to minimize further separation of components in receiver means such as storage vessels, pipelines or further treating equipment.

It should be noted that this process requires no chemical adsorbants or absorbants, nor does it require the external flow of energy or heat or coolant. Internal cool streams are used for cooling where necessary and internal hot streams are used for heating or adjusting temperatures where necessary. Additional internal heating or cooling steps can be added in view of this disclosure for particular embodiments.

In heat exchanger 36 cold liquid product 38 is used to cool the hot gas stream 35 which passes to expanded gas separator 23 as stream 37. The liquid product 38 exits heat exchanger 36 as stream 43 through valve 44 and into separator 45. From separator 45 gas product 47 is removed as well as liquid product 46.

Figure 2:
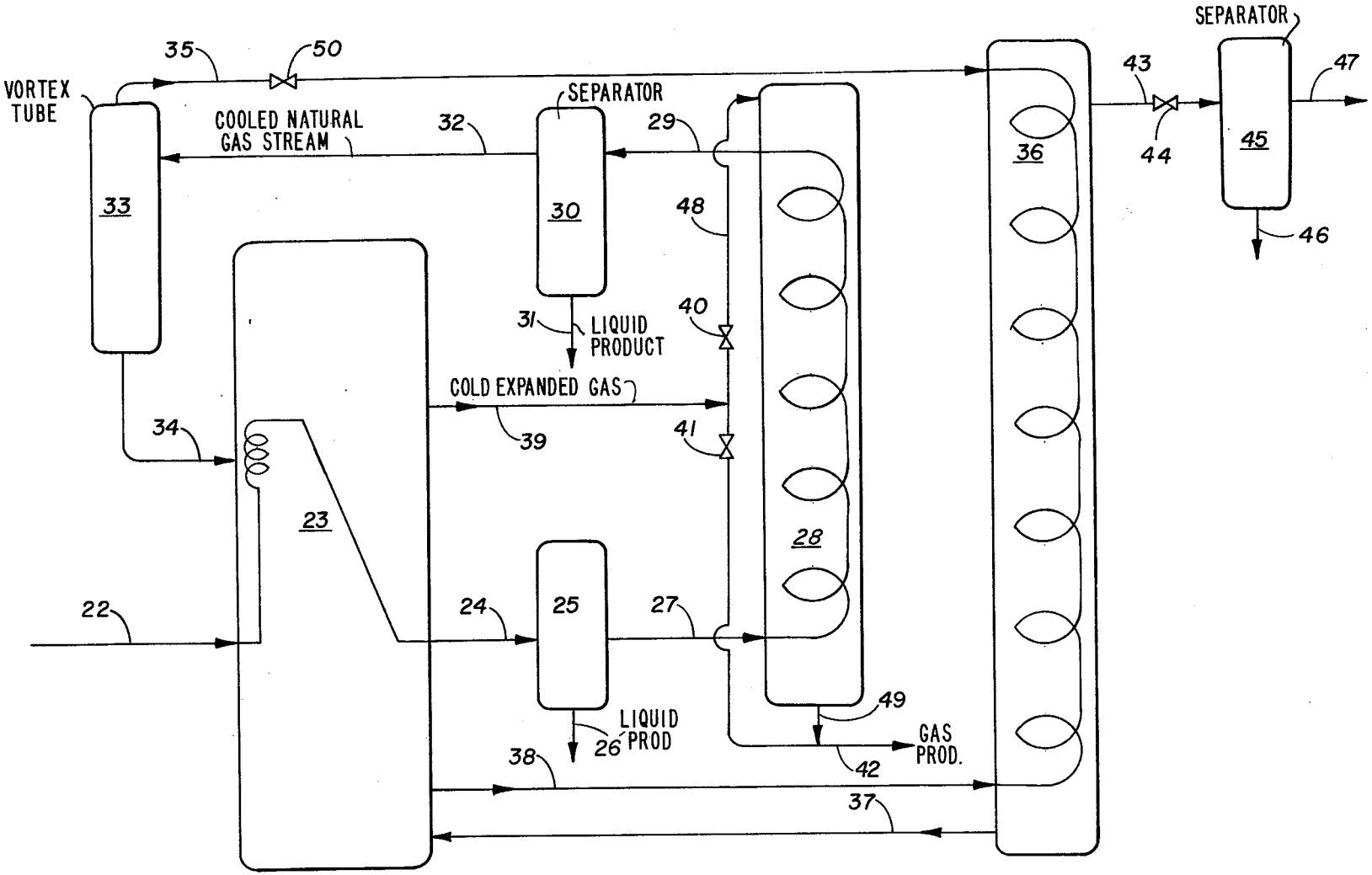
FIG. 2 illustrates a flow diagram of a modified process.

Another process is shown in FIG. 2 in which feed natural gas stream 22 passes through at least one set of coils in the expanded gas separator 23 and as stream 24 into the liquid gas separator 25. Liquid product is removed as stream 26 and passed to separator 23 or a product receiver (not shown). The natural gas stream is removed as stream 27 and passes through heat exchanger 28 emerging as stream 29 and passing to liquid gas separator 30. Liquid product is removed as stream 31 and passes to separator 23 or a liquid product receiver (not shown). Cooled natural gas feed stream 32 passes into the vortex tube 33. Cold gas stream 34 then enters the expanded gas separator 23. The hot gas stream 35 then passes to heat exchanger 36 through valve 50 which controls the proportion of streams 34 and 35. The cooled hot gas stream 37 passes from the heat exchanger 36 to the expanded gas separator 23. Expanded gas product 39 is withdrawn from the expanded gas separatpr and controlled by valves 40 and 41 so that all or a portion 48 of the expanded gas flows through heat exchanger 28 and exits as stream 49 to combine with the balance of stream 39 at 42. The expanded gas product stream 48 cools the natural gas feed stream 27 as the product gas stream 49 is heated.

The process and apparatus of this invention use standard components. The vortex tube is a standard gas cooling expansion and separating apparatus as described in the following patents: U.S. Pat. No. 1,952,281; U.S. Pat. No. 2,522,787; U.S. Pat. No. 2,581,168; U.S. Pat. No. 2,683,972; U.S. Pat. No. 2,741,899; U.S. Pat. No. 2,807,156; U.S. Pat. No. 2,893,214; U.S. Pat. No. 2,907,174; U.S. Pat. No. 2,971,342; U.S. Pat. No. 3,116,344; U.S. Pat. No. 3,118,286; U.S. Pat. No. 3,296,807; U.S. Pat. No. 3,546,891; U.S. Pat. No. 3,566,620; U.S. Pat. No. 3,691,408; U.S. Pat. No. 3,775,988.

The separators of the conventional gravitational and baffle separation type can be used in the process and apparatus of this invention. Cyclones and demisters can also be used, as well as simple knock out pots, for removal of solids and/or condensate at certain points. Each cooling or separation step can be performed in one or more stages using one piece of equipment for several functions or completely separate equipment for each stage if desired. The product receivers can be tanks, pipelines or other vessels typically used to receive gas or liquid products under the desired conditions.

A preferred apparatus of this invention is referred to as an HTX unit and can be described with reference to FIG. 1 as an apparatus for removing condensable components from a high pressure natural gas stream 1 using a closed energy cycle comprising an expanded gas separator means 2 with connecting means for producing a cold environment for cooling said high pressure gas stream and passing said cooled high pressure gas stream to a separator means 4; at least one separator means 4 with connecting means for removing condensed components from said cooled high pressure gas stream 5 and passing said cooled high pressure gas stream to a heat exchanger means 7 and said condensed components to a liquid product receiving means; a first heat exchanger means 7 with connecting means for cooling said high pressure gas stream using expanded cold gas product 15 from said expanded gas separator means to cool said high pressure gas stream and passing said gas product to a gas product receiving means for receiving said gas product; a vortex chamber means 10 with valve means and connecting means for expanding and separating said high pressure gas stream into a hot gas stream 12 and a cold gas stream 11, wherein the cold gas is passed to said expanded gas separator means 2 and said hot gas stream is passed to a second heat exchanger means 14; and said second heat exchanger means 14 with valve means and connecting means for cooling said hot gas stream using liquid product 18 from said expanded gas separator means and passing said liquid product to a liquid product receiving means for receiving said liquid product.

Conventional equipment and gas processes are also described in the following references:

Nelson, W. L.: PETROLEUM REFINERY ENGINEERING, Fourth Edition, McGraw-Hill Book Company, Inc., New York, 1958.

Katz, Donald L., David Cornell, Riki Kobayashi, Fred H. Poettman, John A. Vary, Jack R. Elenbaas and Charles F. Weinaug: HANDBOOK OF NATURAL GAS ENGINEERING, McGraw-Hill Book Company, Inc., New York, 1959.

Fekete, Lancelot A.: Vortex Tube has possibilities for High-Pressure Gas Wells, THE OIL AND GAS JOURNAL, Aug. 7, 1967:143.

Laurence, Lawton L. and Charles W. Hayes: Low Temperature

Separation Applied to Lease Production of Stable Condensate and Natural Gasoline, API DRILL. PROD. PRACTICE, 1952:318.

Wiggins, J. L.: Low Temperature Separation, PETROL. ENGR., 29(2):B65 (1957).

Francis, A. W.: Low Temperature Separation as Applied to Gas Condensate Production, API DRILL. PROD. PRACTICE, 1951:103.

Mertz, R. V.: Low Temperature Gasoline Extraction, PETROL. ENGR., 28(6): C34 (1956).

Campbell, John M.: Some Economic Factors Affecting the Refrigeration of Gas Streams for Greater Condensate Recovery, API DRILL. PROD. PRACTICE, 1955:287.

Gravis, C. K., T. O. David, and R. E. Fields: Practical Application of Low-temperature Separation and Stabilization, API DRILL. PROD. PRACTICE, 1955:266.

Scheller, Wm. A.. and George M. Brown: The Ranque-Hilsch Vortex Tube, INDUSTRIAL AND ENGINEERING CHEMISTRY, Vol. 49, No. 6: 1013 (1957).

Cooney, David O.: Transient Phenomena Observed During Operation of a Ranque-Hilsch Vortex Tube, IND. ENG. CHEM. FUNDAM., 10(2): 308 (1971).

The above patents, articles and references are incorporated herein by reference to the extent necessary.

The process of this invention is preferably a closed energy cycle which means that no additional energy needs to be added for heating or cooling purposes. The heating and cooling are provided by the expansion and separation of the gas stream in the vortex tube with the application of this heating and cooling function in a particular fashion to the natural gas feed stream and recovery of heat from the product streams. From this disclosure, it will be obvious that certain features can be modified by the addition of heating or cooling steps to change the economics and efficiency for processing particular gas streams but such additional energy steps are not essential to the process of this invention. Likewise, multi-stage vortex cooling and separation can be used in view of this disclosure. Certainly conventional treating, cooling, pumping and recycling steps will be obvious and can be used with the processes of this invention in view of this disclosure, even those which use external power and heat exchange for particular processes and natural gas streams. For example, external dehydration or condensation of carbon dioxide for streams high in water vapor or carbon dioxide might be preferred for certain applications in view of this disclosure and would be considered within this invention.

While the preferred processes and apparatus of this invention are more efficient and more economical than previous low temperature natural gas treating processes, any one or all of the particular combination of steps, sequence of steps or individual features within the processes can significantly affect the efficiency and economy. Other sequences of steps can also be used in view of this disclosure. A significant feature is the maximum recovery of condensable components by separately cooling of the hot gas stream from the vortex tube with recovery or recycle of the stream. Significant quantities of condensable components are associated with this stream. Another significant feature is the recovery of cooling potential and adjustment of the temperature and pressure of product stream by using these streams for cooling at various points within the process.

I claim:

1. A method of treating natural gas in a closed energy cycle process to recover condensable components in said stream comprising cooling a high pressure gas stream to a temperature in the range of about 25°–60° F by passing said high pressure gas stream through a cold environment provided by an expanded gas in an expanded gas separator; separating condensed components from said high pressure gas stream; introducing said cooled high pressure gas stream into a vortex chamber tangentially, expanding said gas at high velocity, and separating said gas stream into a hot gas stream and a cold gas stream; passing said cold gas stream into said cold environment as part of said expanded gas in said expanded gas separator to provide said cold environment which cools said high pressure gas stream and to recover therefrom condensable components in said cold environment as liquid product; passing said hot gas stream through a cooler where it is indirectly cooled by said cold product from said expanded gas separator and introducing said cooled hot gas stream into said expanded gas separator as another part of said expanded gas to separate and recover condensable components as said cold liquid product; adjusting the temperature and pressure of the expanded gas and passing said expanded gas to a gas product receiver from said expanded gas separator; and adjusting the temperature and pressure of the cold liquid product and passing said liquid product to a liquid product receiver from said expanded gas separator.

2. A method of treating a natural gas stream in a closed energy cycle process for recovering the condensable components in a high pressure natural gas stream comprising cooling said high pressure gas stream to a temperature in the range of about 25°–60° F by passing said high pressure gas stream through a cold environment provided by an expanded gas; removing condensed components from said high pressure gas stream; expanding said cooled high pressure gas stream to a pressure in an intermediate pressure range by swirling said gas stream in a centrifugal chamber at high velocity and separating said gas stream into a hot gas stream and a cold gas stream; passing said cold gas stream into said cold environment in an expanded gas separator to provide said cold environment which cools said high pressure gas stream prior to expansion thereof in said chamber, to recover condensable components as cold liquid product in said cold environment; passing said hot gas stream through a cooler where it is indirectly cooled by said cold liquid product from said expanded gas separator and introducing said now cooled hot gas stream into said expanded gas to separate and recover condensable components as said cold condensed components; passing said cold liquid product from said cooler to a receiver; and from said expanded gas separator passing dry gas hydrocarbon products to a gas product receiver.

3. A method of treating natural gas in a closed energy cycle process to recover condensable components from said natural gas stream and produce a dry natural gas stream comprising cooling a high pressure natural gas stream to a temperature in the range of about 25°–60° F by passing said high pressure gas stream through a cold environment provided by an expanded gas; separating condensed components from said cooled high pressure gas stream; introducing said cooled high pressure gas stream tangentially into a vortex chamber and expanding said gas at high velocity and separating said gas stream into a hot gas stream and a cold gas stream; passing said cold gas stream into said cold environment in an expanded gas separator to provide said cold environment and to separate and recover condensable components as liquid product and a cold dry natural gas stream; indirectly cooling said hot gas stream with a stream of said cold liquid product from said expanded gas separator and introducing the resulting cooled hot gas stream into the expanded gas separator to recover additional condensable cold liquid production and additional cold dry natural gas stream; and from said expanded gas separator passing said cold dry gas hydrocarbon products to a gas product receiver and said cold liquid product to a liquid product receiver after heat exchange with said hot gas stream.

4. A method for recovering the condensable components in a high pressure natural gas stream without external energy exchange comprising precooling said high pressure gas stream in a cold environment of expanded gas to a temperature which said cooling step is in the range of about 45°–60° F; separating any condensed liquid components from said precooled high pressure gas stream; cooling said precooled high pressure gas stream by contacting said precooled high pressure gas stream indirectly with an expanded cold gas stream from said cold environment, which stream is at a pressure in an intermediate pressure range and at a temperature in the range of 25°–35° F; expanding said resulting cooled high pressure gas stream to a pressure in said intermediate pressure range by swirling said gas stream at a high velocity in a vortex chamber and separating said last mentioned expanded gas stream into a cold gas stream and a hot gas stream; passing said expanded cold gas stream into said cold environment to provide said cold environment and separating the condensable components as condensed liquid components from said cold gas stream; heating said last mentioned expanded cold gas stream by contacting it indirectly with said high pressure gas stream and passing said heated expanded cold gas stream to product discharge; cooling said expanded hot gas stream by contacting it indirectly with said condensed components and heating said condensed components; passing said cooled expanded hot gas stream into said cold environment to recover additional condensable components and mixing said expanded cold gas stream with said cooled expanded hot gas stream; and removing a portion of said heated condensed components to liquid product storage.

5. A method of treating a natural gas stream in a closed energy cycle process to recover condensable components in said natural gas stream comprising in the following sequence: cooling a high pressure natural gas stream to a temperature below about 60° F by passing said high pressure gas stream through a cold environment provided by an expanded gas; separating condensed components from said cooled high pressure gas stream; further cooling said high pressure gas stream to a temperature below about 35° F by indirect heat exchange of said high pressure gas stream with cold dry gas driving from said high pressure gas stream as said expanded gas in said cold environment in an expanded gas separator; introducing said cooled high pressure gas stream tangentially into a vortex chamber and expanding said gas at high velocity and separating said gas stream into a hot gas stream and a cold gas stream; passing said cold gas stream into said cold environment as said expanded gas to cool said high pressure gas stream and to separate and recover condensed components as liquid product in said cold environment; passing said hot gas stream through a cooler where it is cooled by said liquid product from said expanded gas separator and introducing said resulting cooled hot gas stream into said expanded gas separator to recover further condensable components; passing the condensed components from said expanded gas separator to a liquid product receiver; and passing the expanded gas product from said expanded gas separator to a gas product receiver.

6. An apparatus for removing condensable components from a high pressure natural gas stream using a closed energy cycle comprising an expanded gas separator means with connected means capable of producing a cold environment with expanded cold gas for cooling said high pressure gas stream and passing said cooled high pressure gas stream to a separator means; at least one such separator means with connecting means removing condensed components from said cooled high pressure gas stream and passing said modified cooled high pressure gas stream from said separator to a heat exchanger means and said condensed components to a liquid product receiving means; said heat exchanger means having connecting means for indirectly cooling said modified high pressure gas stream said heat exchange means using expanded cold gas product from said expanded gas separator means as coolant to cool said modified high pressure gas stream and passing a portion of said cold gas product to a gas product receiving means; a vortex chamber means with valve means and connecting means for expanding and separating said cooled modified high pressure gas stream from said heat exchanger into a hot gas stream and a cold gas stream, wherein the cold gas is passed to said expanded gas separator means to provide said cold environment and said hot gas stream is passed to a second indirect heat exchanger means valve means and connecting means for cooling said hot gas stream using condensate from said cold gas product in said expanded gas separator means as coolant, means for passing said condensate to a liquid product receiving means, and connecting means for passing said cooled hot gas stream to said expanded gas separator means.

* * * * *